US005931643A

United States Patent [19]

Skaggs

[11] Patent Number: 5,931,643

[45] Date of Patent: Aug. 3, 1999

[54] FLUID JET EJECTOR WITH PRIMARY FLUID RECIRCULATION MEANS

[76] Inventor: Bill D. Skaggs, 428 W. Ghent St., Glendora, Calif. 91740-5026

[21] Appl. No.: 08/854,340

[22] Filed: May 12, 1997

Related U.S. Application Data

[60] Division of application No. 08/217,981, Mar. 25, 1994, Pat. No. 5,628,623, which is a continuation-in-part of application No. 08/017,651, Feb. 12, 1993, abandoned.

[51] Int. Cl.[6] ..... F04F 5/44

[52] U.S. Cl. ..... 417/198; 417/174; 417/151

[58] Field of Search ..... 417/151, 174, 417/198

[56] References Cited

U.S. PATENT DOCUMENTS

| | | | |
|---|---|---|---|
| 1,002,753 | 9/1911 | Rees | 417/179 |
| 1,443,315 | 1/1923 | Ehrhart . | |
| 1,521,729 | 1/1925 | Suczek . | |
| 1,589,888 | 6/1926 | Lummis . | |
| 1,804,569 | 5/1931 | Taddiken . | |
| 2,000,741 | 5/1935 | Buckland | 103/267 |
| 2,074,480 | 3/1937 | McLean . | |
| 2,164,263 | 6/1939 | Wall . | |
| 2,382,716 | 8/1945 | Herzmark . | |
| 2,631,774 | 3/1953 | Plummer . | |
| 3,134,338 | 5/1964 | Dodge | 417/198 |
| 3,551,073 | 12/1970 | Petrouits . | |
| 3,640,645 | 2/1972 | Forsythe . | |
| 3,659,962 | 5/1972 | Zink et al. . | |
| 4,744,730 | 5/1988 | Roeder . | |
| 4,842,777 | 6/1989 | Lamort . | |
| 4,846,617 | 7/1989 | Ehrhardt | 417/151 |
| 5,055,003 | 10/1991 | Svensson | 417/198 |
| 5,370,069 | 12/1994 | Monroe . | |
| 5,628,623 | 5/1997 | Skaggs . | |

FOREIGN PATENT DOCUMENTS

| | | | |
|---|---|---|---|
| 1160602 | 1/1964 | Germany | 417/151 |
| 767405 | 9/1980 | U.S.S.R. . | |
| 290742 | 5/1928 | United Kingdom . | |

*Primary Examiner*—Timothy S. Thorpe
*Assistant Examiner*—Cheryl J. Tyler
*Attorney, Agent, or Firm*—Head, Johnson and Kachigian

[57] ABSTRACT

A fluid jet ejector and ejection method wherein a plurality of high velocity jet streams of a primary fluid are discharged through a vacuum chamber into a convergent-divergent diffuser or nozzle to draw a secondary fluid into the chamber in such manner that the secondary fluid is entrained within flow spaces formed between the jet streams and is carried from the chamber through the diffuser means by the jet streams. A modular fluid jet ejector composed of multiple parts which may be economically manufactured and assembled, and a fluid jet ejector assembly consisting of multiple stacked fluid jet ejectors which may be coupled in parallel to provide a high jet pumping rate. Preferred embodiments of the fluid jet ejector include features for directing primary fluid to a flow space at nozzle exits to fill the space with primary fluid to eliminate or greatly reduce the presence of primary fluid therein, thus greatly increasing the efficiency of the ejector device, these features comprising a fluid passage about an exhaust tube for directing primary fluid flow to the flow space.

15 Claims, 7 Drawing Sheets

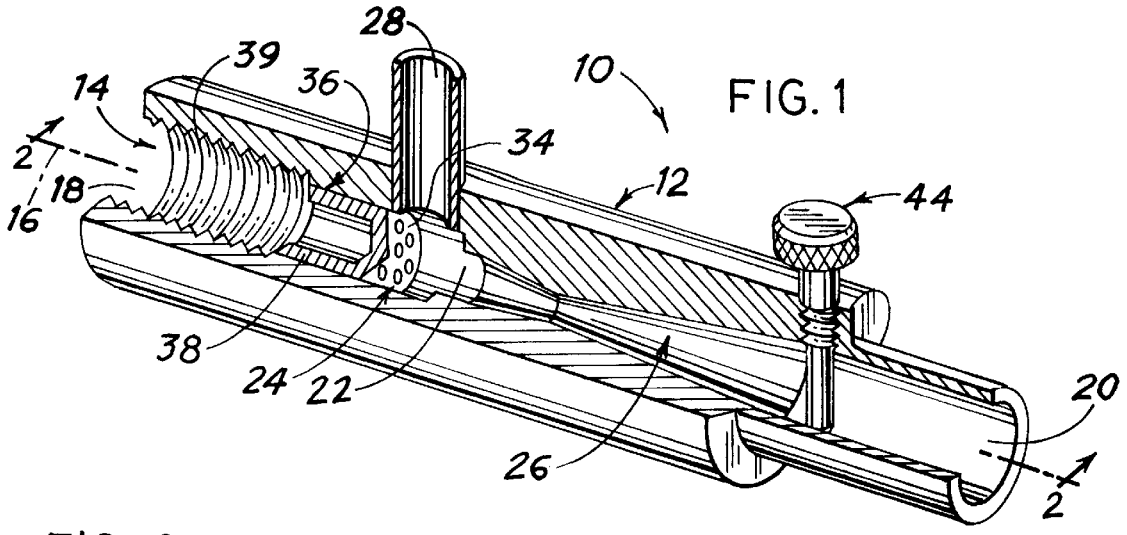
FIG. 1
FIG. 2
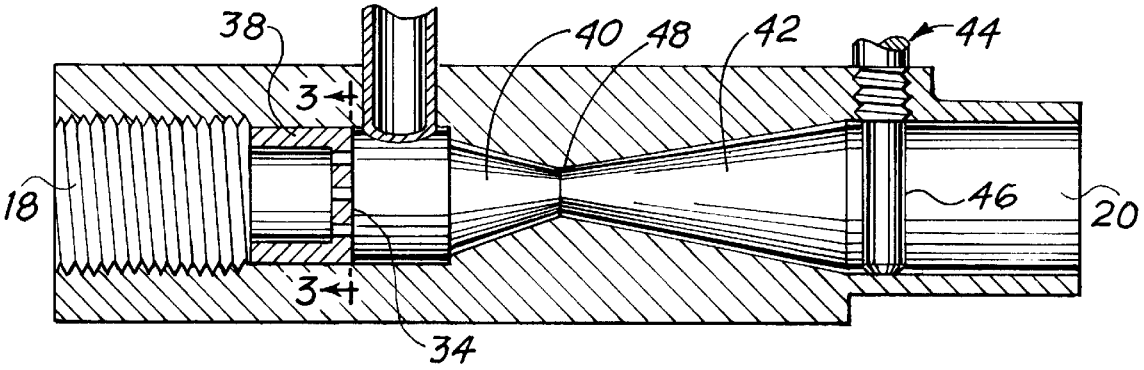
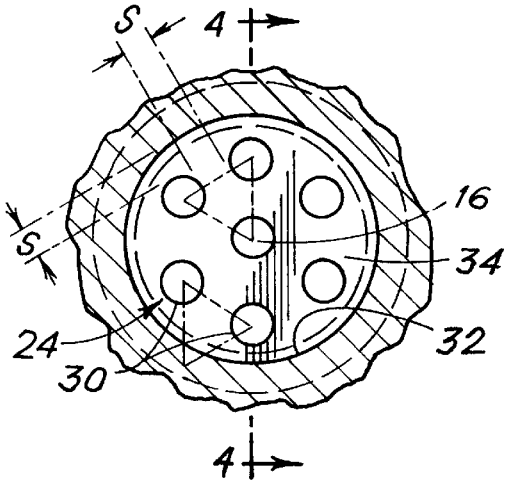
FIG. 3
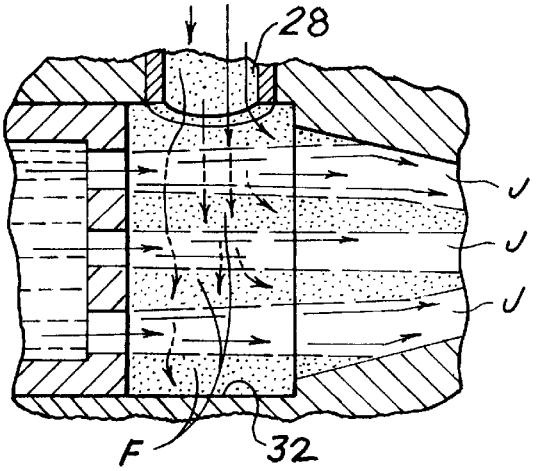
FIG. 4

FIG. 11
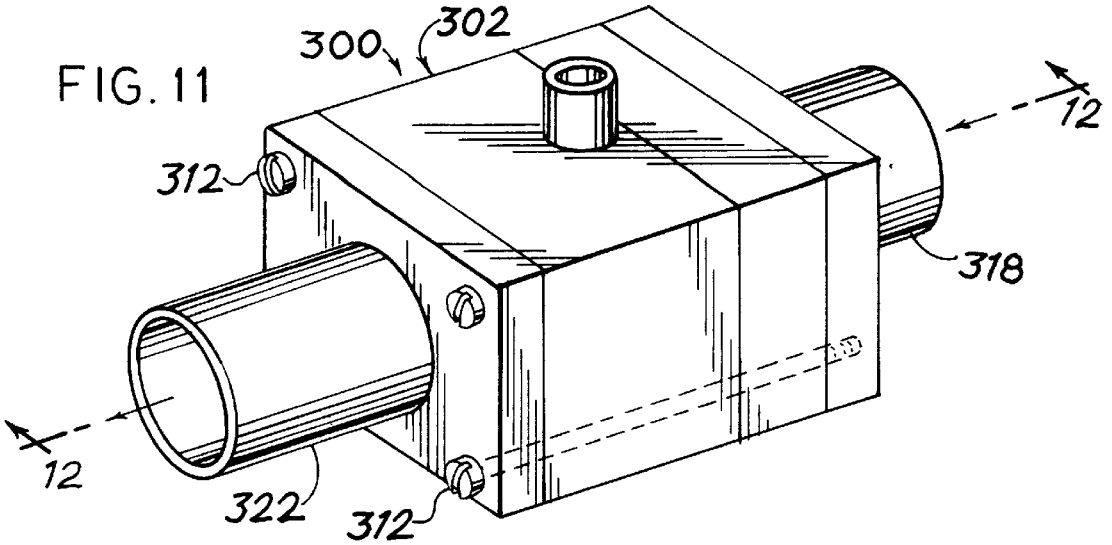
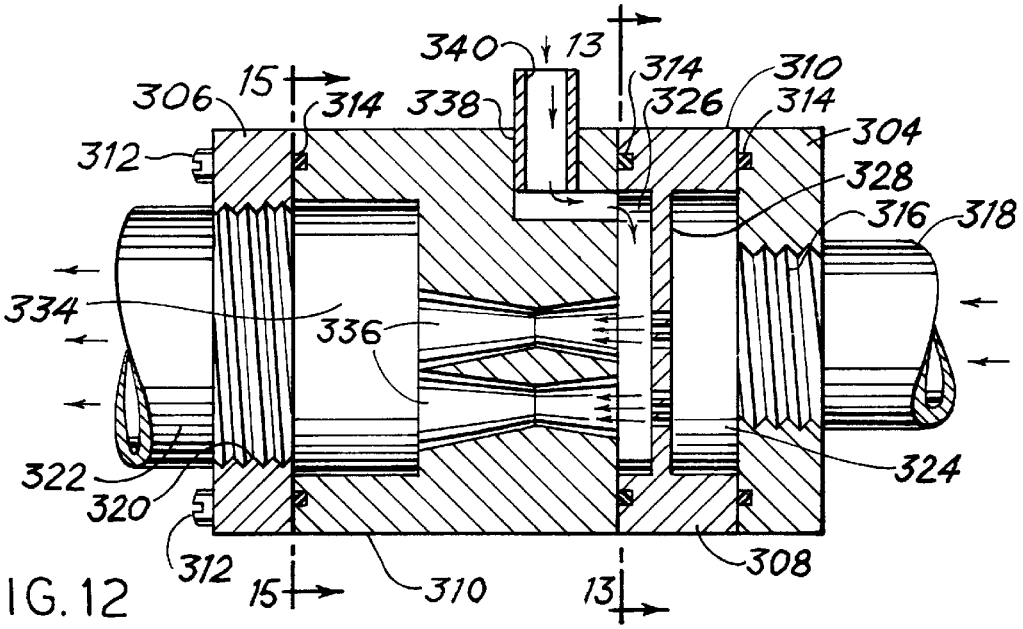
FIG. 12
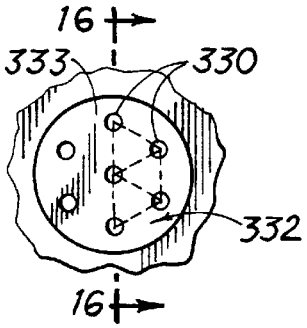
FIG. 14
FIG. 13
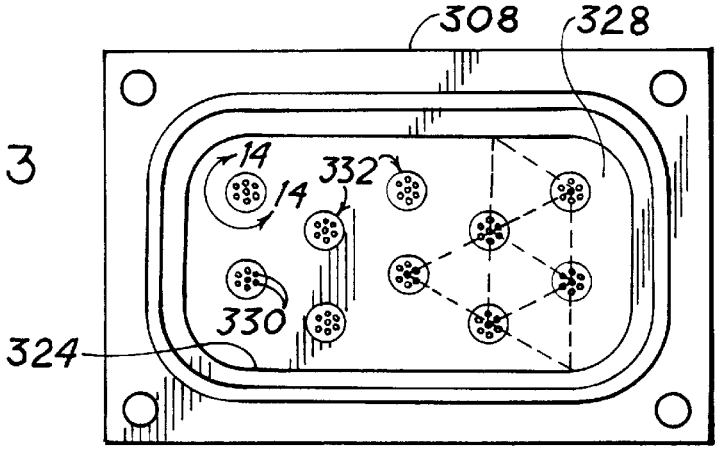

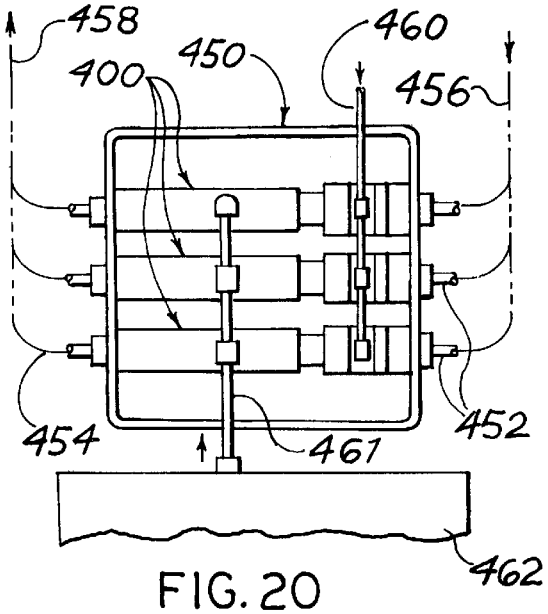
FIG. 20
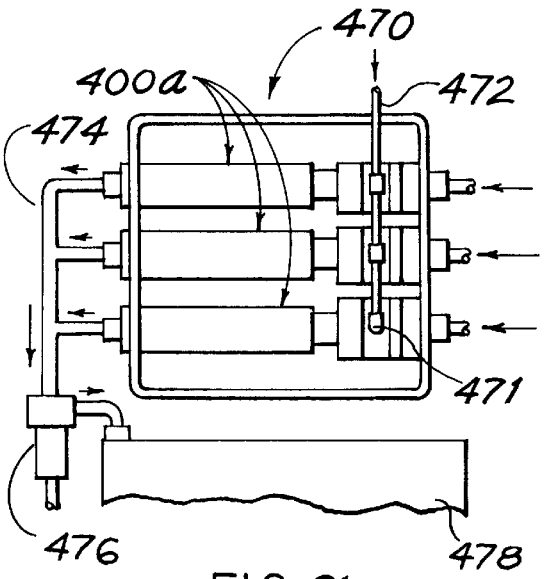
FIG. 21
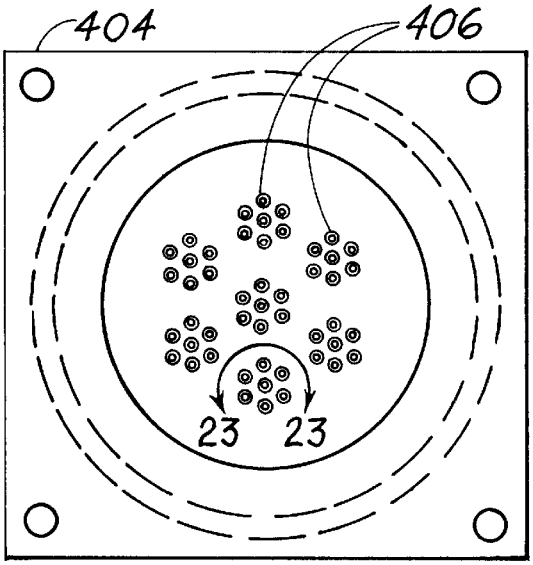
FIG. 22
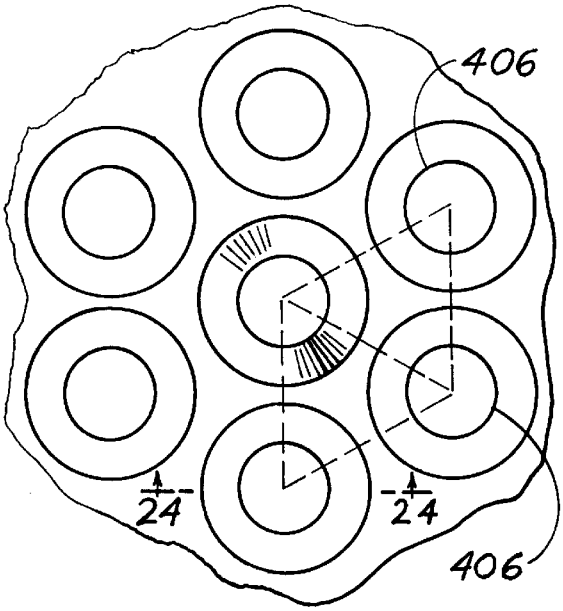
FIG. 23
FIG. 24
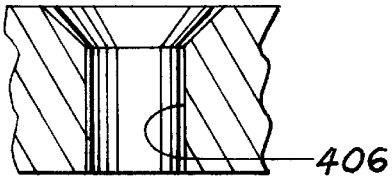

FLUID JET EJECTOR WITH PRIMARY FLUID RECIRCULATION MEANS

RELATED APPLICATIONS

This application is a division of U.S. patent applicatin Ser. No. 08/217,981, filed Mar. 25, 1994, now U.S. Pat. No. 5,628,623, which is a continuation-in-part of application Ser. No. 08/017,651, filed Feb. 12, 1993, now abandoned.

BACKGROUND OF THE INVENTION

1. Field of the Invention

This invention relates generally to fluid handling devices and methods, and more particularly to an improved fluid jet ejector and fluid jet ejection method.

2. Prior Art

Fluid jet ejectors are well known and used for a variety of purposes. Simply stated, a conventional fluid jet ejector comprises a body containing a fluid passage which forms a primary fluid inlet for receiving a pressurized primary fluid, a fluid outlet, a vacuum chamber between the inlet and outlet, a convergent-divergent diffuser communicating the vacuum chamber to the outlet, a nozzle communicating the inlet to the vacuum chamber, and a secondary fluid inlet opening to the vacuum chamber. In operation of the ejector, pressurized primary fluid enters the primary fluid inlet of the ejector and is then accelerated to a high velocity through the nozzle which discharges a high velocity jet stream of the fluid through the chamber into the convergent inlet end of the diffuser.

Acceleration of the primary fluid through the nozzle into the vacuum chamber creates a reduced pressure in the chamber which induces secondary fluid flow through the secondary fluid inlet into the chamber. The secondary fluid is drawn into and entrained by the primary fluid, after which the combined fluids are drawn into the diffuser with the high velocity fluid stream. The combined fluid undergoes acceleration and compression as it passes through the convergent inlet portion of the diffuser and deceleration and expansion as it passes through the divergent outlet portion of the diffuser.

The prior art is replete with a vast assortment of such fluid jet ejectors. Among the patents disclosing such ejectors are the following:

U.S. Pat. No. 1,521,729, dated Jan. 6, 1925 to Suczek disclosing an ejector having convergent tubes N, N1 through which a primary fluid is discharged through vacuum chambers g, r into diffusers D, D1.

U.S. Pat. No. 2,000,741, dated May 7, 1935, to Buckland disclosing a jet pump having a single nozzle 13 and diffuser 12.

U.S. Pat. No. 2,074,480, dated Mar. 23, 1937, to McLean disclosing a thermal compressor having convergent nozzles 7, 10 and a single diffuser 3.

U.S. Pat. No. 2,631,774, dated Mar. 17, 1953, to Plummer Jr. disclosing a thermocompressor having a single nozzle 22 and diffuser 16.

U.S. Pat. No. 3,551,073, dated Dec. 29, 1970 to Petrovits disclosing a jet inducer having a single nozzle 24 the diffuser 38.

SUMMARY OF THE INVENTION

This invention provides an improved fluid jet ejector and fluid jet ejection method which may be utilized with any liquid or gas fluids, including steam, air, and water, and for a variety of fluid handling purposes including vacuum pumping, fluid mixing, and fluid compression. Among the advantages of the invention are the following: ability to pull a substantially greater vacuum and in substantially reduced time; substantially increased flow volume; substantially reduced vulnerability to clogging by particulates entrained in the fluid; simplicity construction; and, economy of manufacture.

The improved ejector of the invention has a body containing a fluid passage which includes a primary fluid inlet, an outlet, a vacuum chamber between the inlet and outlet, diffuser means communicating the chamber and outlet, a secondary fluid inlet opening to the chamber, and jet means communicating the inlet to the chamber for discharging primary fluid at high velocity through the vacuum chamber into the diffuser means. During operation of the ejector, acceleration of the primary fluid through the jet means into the vacuum chamber creates within the chamber a reduced pressure which induces flow of secondary fluid into the chamber through the secondary fluid inlet. This entering secondary fluid is entrained within the high velocity primary fluid and is carried from the chamber through the diffuser means by the primary fluid.

According to one important aspect of the invention, the jet means comprises at least one jet group containing a plurality of jets for discharging a plurality of high velocity jet streams of the entering primary fluid through the vacuum chamber into the diffuser means. As viewed along their axes, these jets are arranged in a two dimensional array. The jets in the array include sets of jets whose arrangement is such that the jet streams issuing from the jets form within the vacuum chamber flow spaces between the adjacent jet streams. The secondary fluid entering the chamber through the secondary fluid inlet is entrained within these flow spaces and is carried from the chamber through the diffuser means by the high velocity primary fluid jet streams. One described embodiment of the invention has a single group of jets which discharge their jet streams into a common diffuser. Another described embodiment has a plurality of jet groups and an equal number of diffusers associated with the jet groups, respectively.

The preferred two dimensional jet array contains seven jets including a central jet and outer jets uniformly spaced circumferentially about and radially from the central jet. This array forms a plurality of jet sets each containing three jets disposed in a triangular arrangement such that the jet streams issuing from the jets of each set form therebetween, within the vacuum chamber, a generally triangular flow space. The several jet streams issuing from all the jets form a plurality of such triangular flow spaces, and additional flow spaces between certain of the jet streams and the wall of the chamber. During operation of the ejector, the secondary fluid entering the vacuum chamber is entrained within these several flow spaces and is carried from the chamber with the jet streams.

One presently preferred embodiment of the invention has a single diffuser, and all of the jets discharge their primary fluid jet streams through the vacuum chamber into this single diffuser. Another preferred embodiment of the invention has a plurality of diffusers and a plurality of jets arranged in groups associated with the diffusers, respectively. The several jets of each jet group discharge their jet streams through the vacuum chamber into the associated diffuser. In these preferred embodiments, the primary fluid jets comprise orifice openings within a wall separating the vacuum chamber from the primary fluid inlet and have parallel axes parallel to the longitudinal axis of the fluid passage through the ejector. The ejector may be operated as a vacuum pump or a fluid mixing device.

According to another aspect, the invention provides a fluid jet ejector operable as a fluid jet compressor. This ejector has a body containing a fluid passage which includes a primary fluid inlet, a primary fluid outlet, a vacuum chamber between the inlet an outlet, diffuser means communicating the chamber and outlet, a secondary fluid inlet opening to the chamber for receiving a gaseous fluid, such as air, a secondary fluid outlet opening downstream of the air/water separator and communicating with the expansion portion of the diffuser means, and fluid jet means communicating the primary fluid inlet to the chamber for discharging at least one high velocity jet stream of the entering primary fluid through the vacuum chamber into the diffuser means. During operation of this fluid ejector, secondary fluid enters the ejector through the secondary fluid inlet and exits the ejector at elevated pressure through the secondary fluid outlet.

Yet another aspect of the invention concerns a fluid jet ejector assembly comprising a plurality of individual fluid jet ejectors each having a primary fluid inlet, a fluid outlet, a vacuum chamber between the inlet and outlet, diffuser means communicating the chamber to the outlet, a secondary fluid inlet opening to the chamber, jet means for discharging at least one relatively high velocity jet stream of primary fluid through the vacuum chamber into the diffuser in a manner such that the high velocity primary fluid entrains secondary fluid entering said chamber throught said secondary inlet, and a secondary fluid inlet manifold connecting the secondary fluid inlets of the several ejectors to a common secondary secondary fluid source. According to this aspect of the invention, the several ejectors are arranged in parallel to draw secondary fluid from a common secondary fluid source. In a modified embodiment of the invention, the several parallel ejectors have secondary fluid outlets opening to the outlet ends of their diffuser means and connected to a common outlet manifold for feeding fluid at elevated pressure to a common receiver. The parallel ejectors may be connected by both a common inlet manifold and a common outlet manifold.

According to a further aspect of the invention, the ejector body has a modular block-like construction and comprises several parts which are joined side by side to form the body. These parts are internally shaped so that when thus joined, the parts form the fluid passage through the body including the primary fluid inlet and outlet, fluid jet means, diffuser means, and secondary fluid inlet. Several ejectors of this type may be stacked on and along side one another to form an ejector assembly of the kind mentioned above.

A feature of the invention resides in an adjustable restricter at the outlet or expansion end of the diffuser. This restricter is adjustable to vary the back pressure at the outlet or expansion end of the diffuser and is set to prevent back flow of fluid through the diffuser past the junction of the inlet compression end and outlet expansion end of the diffuser.

Improved embodiments of the invention comprise added features for the direction of primary fluid, such as water, to a flow space defined between the exit ends of the nozzles and an exhaust tube, thus greatly improving the efficiency of the ejector device by providing sustained partial vacuum in the vacuum chamber, by preventing backflow of secondary fluid via the nozzles to the flow chamber, thus to maintain the desired low pressure therein to effect inflow of secondary fluid. Such features and components comprise a tubular passage defined about an exhaust tube and components, and means for effecting the directing of flow through said passage to said flow space.

BRIEF DESCRIPTION OF THE DRAWINGS

FIG. 1 is a longitudinal section, shown in perspective, through a fluid jet ejector according to the invention;

FIG. 2 is a section taken on line 2—2 in FIG. 1;

FIG. 3 is a section taken on line 3—3 in FIG. 2;

FIG. 4 is a section taken on line 4—4 in FIG. 3;

FIG. 11 is a perspective view of a modular fluid jet ejector according to the invention;

FIG. 12 is a section taken on line 12—12 in FIG. 11;

FIG. 13 is a section taken on line 13—13 in FIG. 12;

FIG. 14 is an enlargement of the area encircled by the arrow 14—14 in FIG. 13;

FIGS. 20 and 21 illustrate multiple ejector assemblies according to the invention;

FIG. 22 is a sectional view taken at line 22—22 in FIG. 18,.showing a preferred form of orifices arrangement;

FIG. 23 is a fragmentary plan view taken at line 23—23 in FIG. 22, and showing a jet array utilized with the invention; and FIG. 24 is a fragmentary sectional view taken at line 24—24 in FIG. 23.

DESCRIPTION OF THE PREFERRED EMBODIMENTS

Figure 5:
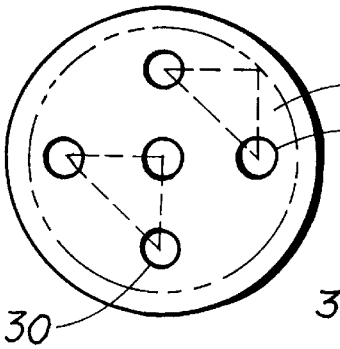
FIGS. 5–7 are views similar to FIG. 3 through modified ejector embodiments.

Referring now to the drawings and first to FIGS. 1–4, the illustrated fluid jet ejector 10 comprises a body 12 containing a fluid passage 14 having a longitudinal axis 16. Passage 12 includes a primary fluid inlet 18, a fluid outlet 20, a vacuum chamber 22 between the inlet 18 and outlet 20, jet means 24 communicating the inlet 18 to the vacuum chamber 22, convergent-divergent diffuser means 26 communicating the vacuum chamber 22 to the outlet 20, and a secondary fluid inlet 28 opening to the vacuum chamber 22.

Briefly, during operation of the ejector, pressurized primary fluid entering the primary fluid inlet 18 is accelerated through the jet means 24 and discharged at high velocity through the vacuum chamber 22 into the diffuser means 26. The fluid exits the ejector through the outlet 20. Acceleration of the primary fluid through the vacuum chamber 22 creates a local reduced pressure in the chamber which induces flow of secondary fluid into the chamber through the secondary fluid inlet 28. The entering secondary fluid is entrained by the high velocity primary fluid passing through the vacuum chamber 22 and is carried with the primary fluid from the chamber through the diffuser means 26. During passage of the combined fluid, i.e. primary fluid and entrained secondary fluid, through the diffuser means, the fluid is first compressed within the inlet portion of the diffuser means and then expanded within the outlet portion of the diffuser means. As mentioned earlier and as will be explained in more detail later, the ejector may be operated with both liquid and gaseous fluids, including air, water, and steam, and utilized for various purposes including use as a vacuum pump, a fluid mixing device, and a fluid compressor.

According to one important aspect of the invention, the jet means 24 comprises a plurality of individual jets 30 which discharge a plurality of relatively high velocity jet streams J of primary fluid through the vacuum chamber 22 into the diffuser means 26. These several jets 30 have substantially parallel axes parallel to the fluid passage axis 16 and are arranged in a two dimensional array when viewed along their axes, as in FIG. 3. The arrangement of the jets in the array is such that the several jet streams J of primary fluid which issue from the jets are laterally spaced to form within the vacuum chamber 22 flow spaces F between the adjacent jet streams and between certain of the jet streams and the wall of the vacuum chamber. The secondary fluid entering the vacuum chamber 22 through the secondary fluid inlet 28 is entrained within the flow spaces F by the jet streams.

Figure 7:
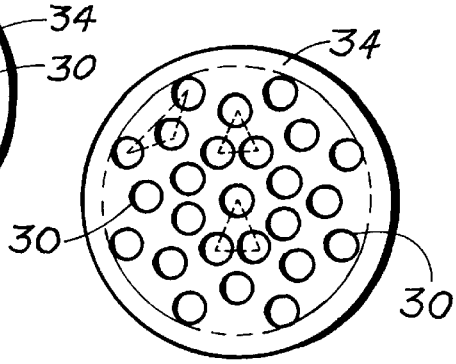
Figure 6:
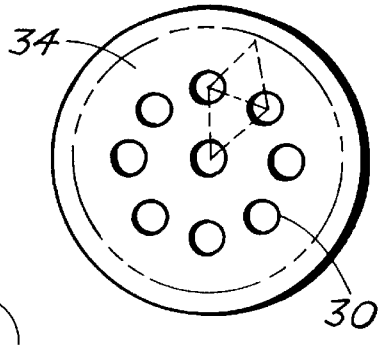

The preferred jet array is that illustrated in FIG. 3 and comprises seven jets including a central jet located on the axis 16 of the fluid passage 14, and six outer jets equally spaced about the central jet. It will be observed that this jet array includes a plurality of sets of jets 30 each including three jets disposed in a generally triangular arrangement. The three jets of each such jet set from therebetween a flow space F of generally triangular transverse cross-section. Each pair of adjacent outer jets and the vacuum chamber wall 32 form an additional flow space F. The seven jets have equal diameter which is preferably on the order of 0.052 inches. The spacing S between the adjacent outer jets and the corresponding spacing between each outer jet and the central jet are preferably equal to the jet diameter, i.e. 0.052 inches. FIGS. 5–7 illustrate other possible jet arrays including 5, 9, and 25 jets, respectively.

According to another important aspect of the invention, the several jets 30 comprise orifice-like openings through a wall 34 which separates the primary fluid inlet 18 from the vacuum chamber 22. In the preferred embodiment illustrated, this wall is an end wall of a generally cup-shaped insert 36 having a cylindrical body 38 closed at one end by the wall 34. Insert 36 is press-fitted or otherwise fixed within the fluid passage 14 between the inlet 18 and the vacuum chamber 22. The portion of the passage 14 upstream of the wall 34 forms a fluid inlet chamber 39 which is internally threaded for connection to a primary fluid infeed conduit, not shown.

In the preferred ejector embodiment of FIGS. 1–4, the diffuser means 26 comprises a single convergent-divergent diffuser that receives the jet streams from all the jets 30. This diffuser has an upstream convergent compression chamber 40 and a downstream divergent expansion chamber 42. During ejector operation, primary fluid entering through the primary fluid inlet 18 and secondary fluid entering through the secondary fluid inlet 28 and entrained in the primary fluid undergo compression and acceleration during passage through the diffuser compression chamber 40 and expansion and deceleration during passage through the diffuser expansion chamber 42.

Threaded in the ejector body 12 downsteam of the diffuser expansion chamber 42, on an axis transverse to the axis 16 of the fluid passage 14, is a restrictor 44. This restrictor includes an inner stem 46 which extends part way across the passage 14 to provide in the passage a restriction that creates a back pressure in the diffuser. The restrictor is adjustable axially to vary the restriction and thereby the back pressure. Too little back pressure will result in back flow of a gaseous fluid from the diffuser expansion chamber 42 to the vacuum chamber 22. Too much back pressure will result in back flow of a liquid fluid from the diffuser expansion chamber 42 to the vacuum chamber. The restrictor is set in a position which provides a back pressure such that the diffuser throat 48 forms a check-valve-like separation region which prevents back flow of fluid from the diffuser expansion chamber to the vacuum chamber 22. The purpose of restrictor 44 is to prevent air backflow through the diffuser. The restrictor may be eliminated if the exhaust tube is sufficiently long to create a sufficient backpressure, for example 2 p.s.i. The restrictor may also be eliminated if the exhaust tube outlet is restricted to produce backpressure.

As mentioned earlier, the fluid ejector of the invention may be utilized for various purposes. For example, the secondary fluid inlet 28 of the ejector 10 may be connected to a vessel to be evacuated, and the ejector may be operated as a vacuum pump for sucking fluid from the vessel through the secondary inlet to evacuate the vessel. Alternatively, the secondary fluid inlet 28 may be connected to a source of secondary fluid to be mixed with the primary fluid supplied to the ejector. In this case, the ejector is operated as a combined pump and mixing device which receives the secondary fluid through the secondary inlet 28 and mixes the secondary fluid with the primary fluid.

Figure 10:
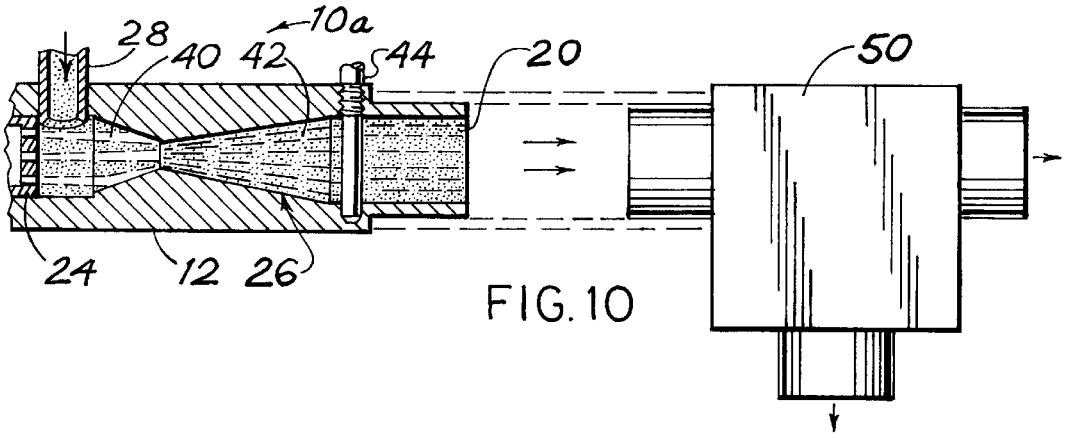
FIG. 10 is a longitudinal section through a modified fluid jet ejector according to the invention.
Figure 15:
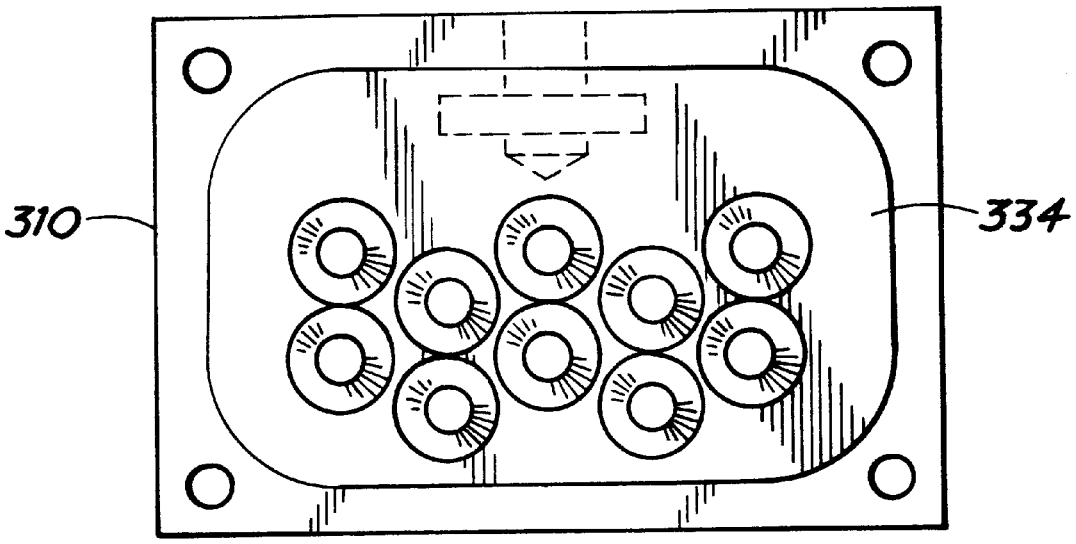
FIG. 15 is a section taken on line 15—15 in FIG. 12.

The modified fluid jet ejector 10*a* of FIG. 10 is operable as a jet compressor. Jet compressor 10*a* is identical to the fluid jet ejector 10 illustrated in FIGS. 1–4 except that the jet compressor is connected to secondary outlet downstream of an air/water separator 50, for the compressed air output of the device. The secondary inlet 28 is connected to a source of gas to be compressed. This gas may be air, in which case the inlet may open to the atmosphere. The gas is entrained in the primary fluid flowing through the compressor, compressed within the diffuser 26, and exits the compressor via the separator 50. The restricter 44 of FIG. 2 is eliminated by having an exhaust tube sufficiently elongated to produce adequate backpressure, or by having a restricted exhaust tube outlet.

Figure 8:
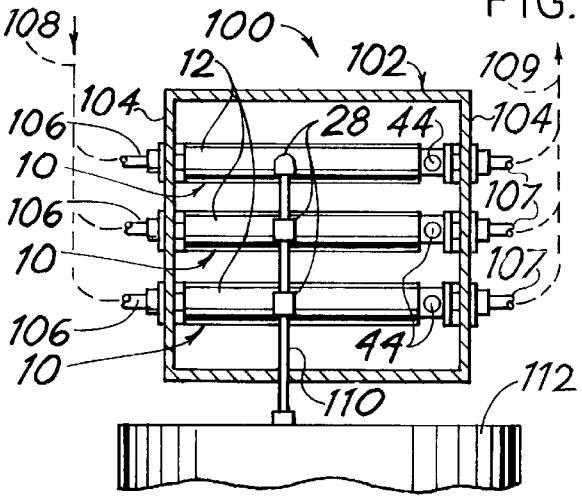
FIGS. 8 and 9 illustrate improved multiple ejector assemblies according to the invention.

Turning now to FIG. 8, there is illustrated a fluid jet ejector assembly 100 according to the invention including a plurality of individual fluid jet ejectors 10. Each injector 10 is identical to the ejector illustrated in FIGS. 1–4. The several ejectors 10 are mounted in a frame or housing 102 including horizontally spaced vertical walls 104. The ends of the ejector bodies 12 extend through and are fixed in any convenient way to the side walls 104. These side walls support the ejectors horizontally one over the other in the vertical stack-like arrangement. Connected to the primary fluid inlets 18 (not shown in FIG. 8) of the several ejectors are fluid supply lines 106 through which primary fluid under pressure is delivered to the ejectors. Connected to the ejector fluid outlets 20 (not shown in FIG. 8) are fluid discharge lines 107 through which fluid exits from the ejectors. If desired, the several fluid supply lines 106 may connect to a single common supply line 108, and the several discharge lines 107 may connect to a single common discharge line 109. The secondary fluid inlets 28 of the several ejectors are connected to a common secondary fluid inlet line 110. In FIG. 8, this inlet line connects to a tank 112 from which fluid is drawn into the individual ejectors 10 through the inlet line 110 during operation of the ejectors. While a single vertical stack of ejectors has been illustrated, the ejector assembly may include additional vertical ejector stacks arranged side by side. In this case, the secondary fluid inlets of all the ejectors may connect to the tank 112 through a common inlet line.

Figure 9:
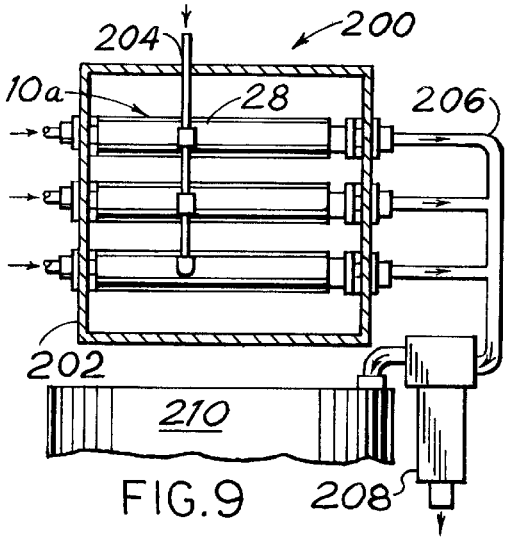

FIG. 9 illustrates a fluid jet ejector or compressor assembly 200 which is similar to the ejector assembly 100 of FIG. 8 and differs from the latter assembly only in the following respects. The individual fluid jet injectors 10*a* of the assembly 200 are identical to the the fluid jet ejector or compressor illustrated in FIG. 10. The several jet compressors 10*a* are mounted in a frame or housing 202 in a manner similar to the mounting of ejectors in figure B. The secondary fluid inlets 28 of the several jet compressors are connected through a common secondary fluid inlet line 204 to a source of gas to be compressed. In FIG. 9, this gas is air, and the inlet line 204 opens to atmosphere, whereby air is drawn into the jet compressors 10*a* from the atmosphere. The jet compressors are connected via a common fluid line 206 to a conventional air/water separator 208, the pressurized air or gas output of which is conducted via a conduit to a pressure storage vessel 210.

In the ejector and compressor assemblies of FIGS. 8 and 9, the several fluid jet ejectors 10 and fluid jet compressors 10*a* are effectively arranged in parallel and their fluid pumping actions are additive. The assemblies may include as many ejectors/compressors as necessary, for example up to one hundred or more, to achieve a desired pumping volume.

The modular fluid jet ejector 300 illustrated in FIGS. 11–16 has a modular, generally rectangular block-like body 302 composed of four separately formed parts 304, 306, 308, 310 disposed side by side with their opposing faces in contact. These parts may be machined or cast parts. The several parts are rigidly joined by bolts 312 and sealed to one another by seal rings 314 between the parts. The two outer parts 304, 306 have the shape of rectangular plates. Part 308 has a flat rectangular block shape. Part 310 has a generally cubic shape. Outer part 304 has a threaded primary inlet 316 connected to a primary fluid inlet line 318. Outer part 306 has a threaded outlet 320 coaxial with the inlet 316 and connected to a fluid outlet line 322.

Figure 16:
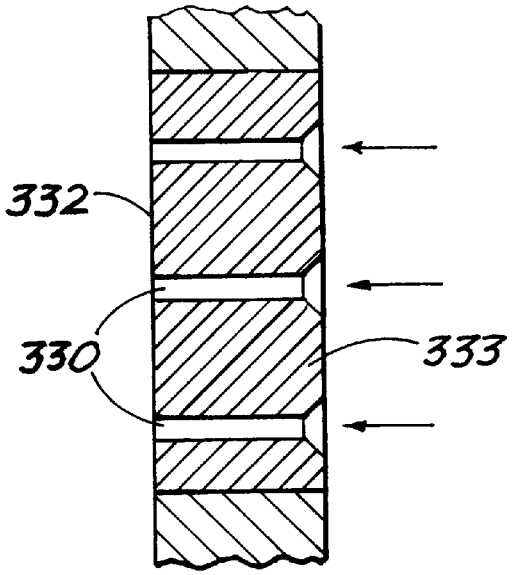
FIG. 16 is an enlarged section taken in line 16—16 in FIG. 14.

Entering the right and left sides (as viewed in FIG. 12) of the part 308 are recesses 324, 326 coaxially aligned with the inlet and outlet 316, 320 and having the generally rectangular shape illustrated in FIG. 13. Recesses 324, 326 form a fluid inlet chamber and a vacuum chamber, respectively, separated by a relatively thin wall 328. This wall contains a multiplicity of small holes 330 which form orifice-like jets. As shown best in FIGS. 13 and 14, the jets 330 are arranged in several groups 332 each containing a plurality of jets. The jets in each group are preferably seven in number, as illustrated, and arranged in the same way as described earlier in connection with FIGS. 1–4. The jet groups 332 are spaced about the wall 328. Preferably, each group of jets is contained in an insert 333 which is fixed within an opening in the wall 328. The inlet ends of the jets 330 are preferably beveled, as shown in FIG. 16. The depth of the bevel is preferably on the order of 70/1000 inches and diameter of the jets is preferably on the order of 80/1000 inches.

Entering the left side of the part 310 is a recess 334 aligned with and having the same rectangular shape and size as the vacuum chamber 326. Recess 334 forms an outlet chamber. Extending through the part 310 between the vacuum chamber 326 and the outlet chamber 334 are a plurality of convergent-divergent diffusers 336. These diffusers are equal in number to and coaxially aligned with the jet groups 332, respectively. Part 310 has a secondary fluid inlet 338 opening to the vacuum chamber 326 and connected to a secondary fluid inlet line 340.

It is obvious from the foregoing description that the modular jet ejector 300 operates in essentially the same manner as the jet ejector 10 of FIGS. 1–4 during primary fluid flow through the ejector from the inlet line 318 to the outlet line 322. Each diffuser 336 is associated with a group 332 of jets 330. Each jet group directs jet streams of primary fluid through the vacuum chamber 326 into the associated diffuser. These jet streams define therebetween flow paths in which secondary fluid entering the inlet 340 is entrained and carried from the ejector with the primary fluid in the same manner as described earlier in connection with FIGS. 1–4. A novel advantage of the modular jet ejector is that a number of the ejectors may be stacked one on the other in any number of vertical stacks arranged side by side to form a jet ejector assembly comprising any number of ejectors which may be interconnected like those in the assemblies of FIGS. 8 and 9 to provide a high pumping volume ejector assembly.

It will be understood that a modular jet ejector assembly 300 of FIGS. 11 and 12 is adaptable for use as a compressor by utilizing jet compressors according to FIG. 10, hereinbefore described, with the output of the compressors passing through a common outlet line to a conventional air/water separator (not shown) from which the compressed air or other gas is discharged under pressure via a conduit to a pressure storage vessel.

Figure 17:
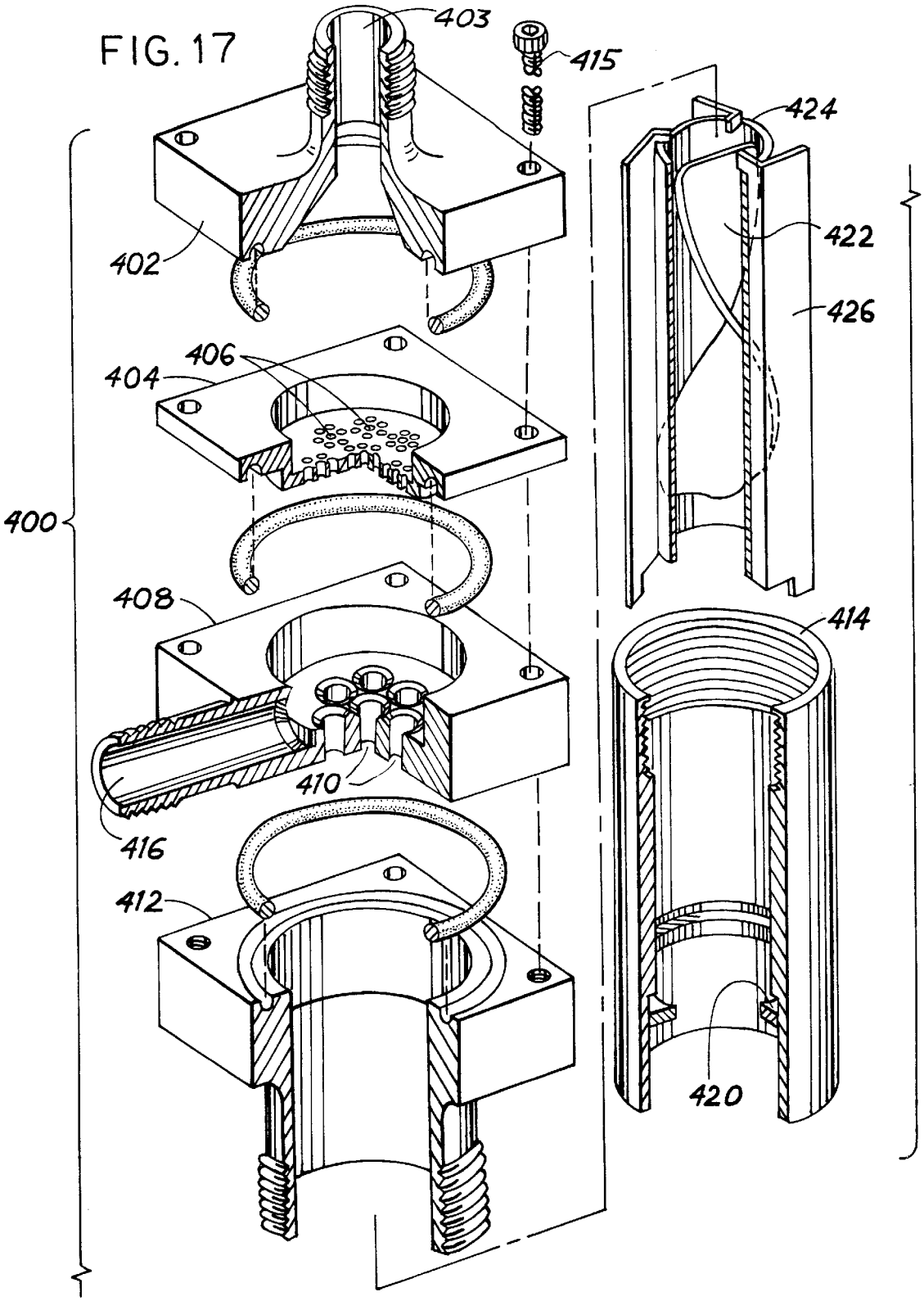
FIG. 17 is an exploded perspective view of another embodiment of the invention which embodies features for improving efficiency by introducing added primary fluid adjacent the nozzle exits.
Figure 18:
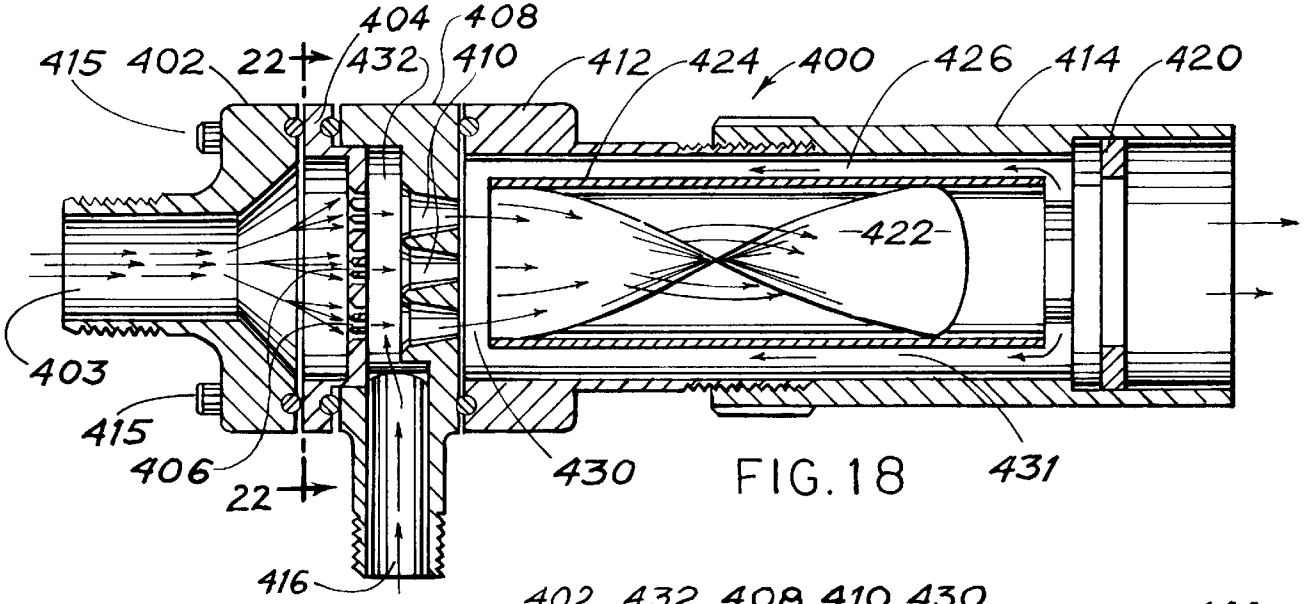
FIG. 18 is an elevational sectional view of the jet ejector of FIG. 17.
Figure 19:
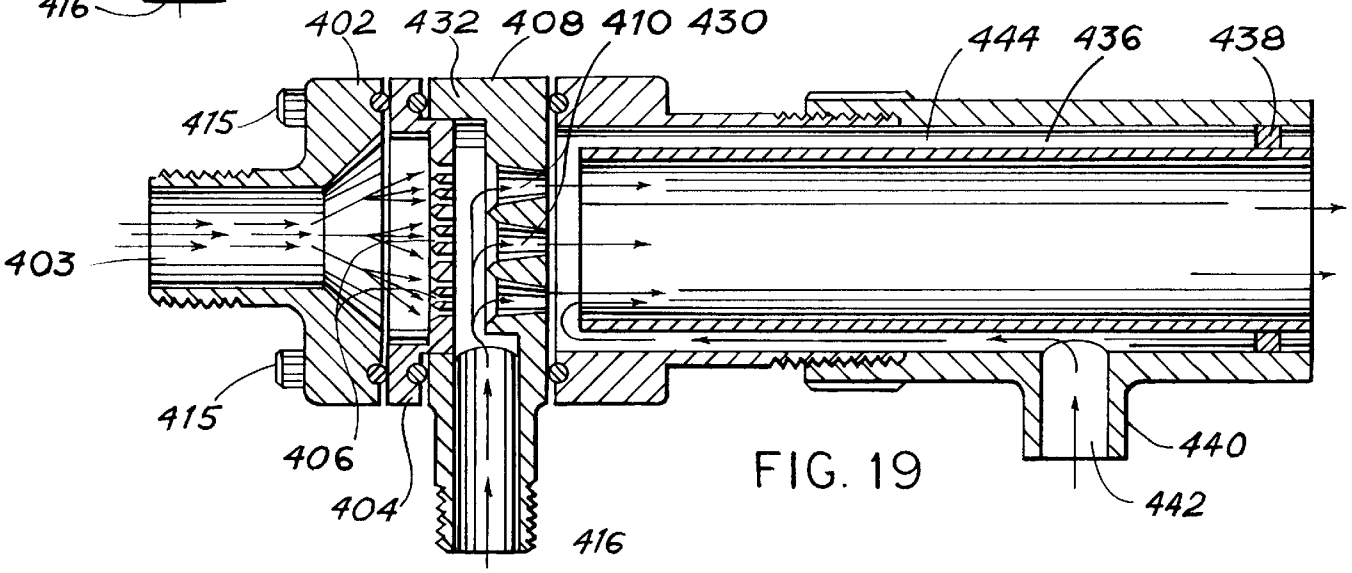
FIG. 19 is a sectional view similar to that of FIG. 18, showing a further embodiment for the introduction of added primary fluid adjacent the nozzle exits.

FIGS. 17 to 19 illustrate embodiments of the invention which provide greatly improved efficiency and performance by substantially reducing or eliminating the presence of secondary fluid or air at the output sides of the nozzles.

The fluid jet ejector 400 of FIG. 18 comprises an inlet member 402 which defines an inlet 403 for a primary fluid, such as water, a generally cup-shaped orifice member 404 which defines a plurality of orifices 406 similar to those of the earlier-described embodiments of the invention, a central member 408 wherein are defined a plurality of nozzles 410 like those of the earlier-described embodiments, an outlet housing member 412, and a housing extension member 414 threadedly secured to member 412, as shown. FIG. 22 shows a preferred form of the orifices 406, and FIG. 23 illustrates the geometric arrangement of a preferred form of jets 406. The members 402, 404, 408 and 412 are secured together by an elongated threaded fastener or tie rod 415 which extends through the members and is threadedly secured in member 412. Member 408 has an inlet passage 416 for passage of a secondary fluid, such as air.

A tubular fluid passage 431 is defined between exhaust tube 424 and coaxial housing members 412 and 414. Secured in member 414 is an annular diverter 420 which extends radially inwardly, as shown.

A spiral member 422 is mounted within an exhaust tube 424, as by welding, and has a twist of one hundred eighty degrees or more. Exhaust tube 424 is positioned relative to the housing member by spacer elements 426 (FIG. 17). Exhaust tube 424 has its upstream end spaced from member 408 and the outlets of nozzles 410, thus to define a flow space 430.

In the operation of the device of FIGS. 17 and 18, convergent orifices 406 produce jet streams like those of the earlier-described embodiments. The fluid, typically water, is discharged at high velocity through chamber 432 and toward the compression nozzles 410, as indicated in FIG. 4 of an earlier-described embodiment. The discharge is at high velocity through vacuum chamber 432 into the convergent nozzles 410. The fluid exits the ejector via exhaust tube 424. As with the earlier embodiments, acceleration of the primary fluid through the vacuum chamber creates local reduced pressure in this chamber, which induces flow of secondary fluid, such as air, into the chamber via secondary fluid inlet 416. The entering secondary fluid is entrained by the high velocity primary fluid, typically water, passes through the vacuum chamber, and is carried with the primary fluid from the chamber through the converging nozzles 410. During passage of the combined fluid through the convergent nozzles, the fluid is compressed. As earlier described, the ejector may be operated with both liquid and gas fluids, such as air, water and steam, and utilized for various purposes, such as a vacuum pump, a fluid mixing device, and a fluid compressor.

Secondary fluid entering the vacuum chamber 432 via the secondary fluid inlet 416, is entrained in the jet streams in the same general manner as with the earlier-described embodiments.

The mixed fluid exiting the nozzles 410 passes through flow space 430 and is given a spiral path and movement by the spiral member 422. The mixed fluid is thus centrifugally urged radially outwardly against the inner wall of exhaust tube 424. The fluid thus impelled toward the wall of tube 424 passes therealong and impacts or engages diverter 420, whereupon a substantial portion thereof is reversed in directional flow and is impelled, as indicated by the arrows in FIG. 18, in the reverse direction via the tubular passage 432, while the jet streams of mostly secondary fluid (air) are exhausted and expelled from exhaust tube 424. The flow thus redirected passes to the flow space 430, thus to fill this space with primary fluid, substantially eliminate any secondary fluid (air) and turbulence therein, and prevent secondary fluid (air) from being drawn via nozzles 410 back into the vacuum chamber 432. Such backflow to chamber 432 would increase the pressure and reduce partial vacuum, thereby substantially reducing the intake of secondary fluid via intake 416, and substantially reducing the efficiency and performance of the ejector device. The efficiency of the fluid ejector device is greatly increased by maintaining appropriate low pressure and partial vacuum in chamber 432 to effect "solid" water jets with entrained air, passing from the nozzles to the exhaust tube. With the improved and maintained partial vacuum in the vacuum chamber effected in the manner described, the intake at inlet 416 provides high efficiency production of partial vacuum for application to and use with other equipment (not shown). With the arrangement, partial vacuum is readily maintained of 29" Hg below atmospheric pressure.

The embodiment of FIG. 19 is like that of FIG. 18 with respect to a number of components and features, and like features bear like reference numerals. This ejector embodiment differs in that no spiral member is provided within an exhaust tube 436, an annular closure member 438 is provided about the outer end portion of the exhaust tube 436, to close the annular passage 444, and an input passage 442 is provided for input of primary fluid along a line 461 from a source or tank 462 (FIG. 20).

Referring to FIG. 19, the jets from nozzles 410 pass through the flow space 430 and exit via the exhaust tube 436. The partial vacuum produced in chamber 430 causes an inward flow of primary fluid, typically water, via inlet passage 442 and thence through the tubular passage 444 to the flow space 430, thus to insure that space 430 is filled with water to substantially eliminate any secondary fluid, typically air, or eddies thereof in space 430. Such elimination greatly increases the efficiency of the ejector in maintaining low pressure in chamber 432 and providing continuous desired partial vacuum at the secondary inlet 442 Efficiency and performance are greatly improved.

Referring to FIG. 20, there is illustrated a fluid jet ejector assembly 450 according to the invention including a plurality of individual fluid jet ejectors 400. Each injector is identical to the injector illustrated in FIGS. 17–19. The several ejectors are mounted in a frame or housing. Connected to the primary fluid inlets (not shown in FIG. 20) of the several ejectors are fluid supply lines 452 through which primary fluid under pressure is delivered to the ejectors. Connected to the ejector fluid outlets (not shown in FIG. 20) are fluid discharge lines 454 through which fluid exits from the ejectors. If desired, the several fluid supply lines may connect to a single common supply line 456, and the several discharge lines 454 may connect to a single common discharge line 458. The secondary fluid inlets 416 of the several ejectors are connected to a common secondary fluid inlet line 460. In FIG. 20, inlet line 461 connects to a tank 462 from which fluid is drawn into the individual ejectors 400 through the inlet line during operation of the ejectors. While a single vertical stack of ejectors has been illustrated, the ejector assembly may include additional vertical ejector stacks arranged side by side.

FIG. 21 illustrates a fluid jet ejector or compressor assembly 470 which is similar to the ejector assembly 450 of FIG. 20 and differs from the latter assembly in the following respects. The individual fluid jet ejectors 400*a* of the assembly are identical to the fluid jet ejectors of the compressor of FIG. 20. The several jet compressors are mounted in a frame or housing in a manner similar to the mounting of ejectors in FIG. 9. The secondary fluid inlets of the several jet compressors are connected through a common secondary fluid inlet line 472 to a source of gas to be compressed. In FIG. 21, this gas is air, and the inlet line 472 opens to atmosphere, whereby air is drawn into the jet compressors 400*a* from the atmosphere. Secondary fluid inlets 471 admit atmospheric air. The jet compressors are connected via a common fluid line 474 to a conventional air/water separator 476, the pressurized air or gas output of which is conducted via a conduit to a pressure storage vessel 478.

Thus there has been shown and described a novel fluid jet ejector and ejection method which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

I claim:

1. A fluid jet ejector comprising:

a body having a fluid passage including a primary fluid inlet for receiving a pressurized primary fluid, a fluid outlet, a vacuum chamber between said inlet and outlet, at least one group of jets communicating said inlet to said chamber, nozzle means communicating said chamber to said outlet, and a secondary fluid inlet opening to said chamber for receiving a secondary fluid, said fluid outlet comprising exhaust passage means spaced from said nozzle means and cooperating therewith to define a flow space, and means for directing additional primary fluid to said flow space to minimize the presence of secondary fluid and eliminate flow of secondary fluid via the nozzle means to said vacuum chamber.

2. A fluid jet ejector according to claim 1, wherein:

said exhaust passage means comprise an exhaust tube, and further including means cooperating with said exhaust tube to define a generally tubular passage, and means for directing primary fluid via said passage to said flow space to eliminate secondary fluid from the flow space.

3. A fluid jet ejector according to claim 2, wherein:

said means cooperating with the tubular exhaust member to define said tubular passage comprises an outer housing means spaced from said exhaust tube, and said means for introducing primary fluid into said passage comprises diverter means extending inwardly from said outer housing means to divert exhaust flow in the tube into said tubular passage.

4. A fluid jet ejector according to claim 3, and further including:

a spirally configurated member in said exhaust tube to impart spiral centrifugal motion to exhaust flow therein to urge exhaust flow toward the exhaust tube to impinge upon said diverter to direct flow through said tubular passage to said flow space.

5. A fluid jet ejector according to claim 4, wherein:

said spirally configurated member is secured to the inner wall of the exhaust tube at spaced locations, and jets from the nozzles pass through said flow space and are directed into a spiral path and impelled radially outwardly against the exhaust tube by the spiral member to engage the inwardly extending diverter and be impelled into said passage toward said flow space.

6. A fluid jet ejector according to claim 2, wherein said means cooperating with the tubular exhaust member to define said tubular passage comprises an outer housing means spaced from said exhaust tube, and said tubular passage being closed adjacent the outer end of the exhaust tube, and inlet passage means communicating with said tubular passage for admitting primary fluid thereinto to pass to said flow space.

7. A fouid jet ejector according to claim 6, wherein:

the jets of each jet group have a certain diameter and a generally uniform spacing substantially equal to said diameter between the outer circumferences of adjacent jets.

8. A fluid jet ejector according to claim 6, wherein:

the jets of each jet group include a plurality of sets of jets each including three jets disposed in a generally triangular arrangement, and the three jets of each jet set form therebetween a flow space of generally triangular transverse cross-section.

9. A fluid jet ejector according to claim 8, wherein:

the number of jets in each jet group is seven.

10. A fluid jet ejector according to claim 2, wherein:

each jet group includes a plurality of sets of jets each including three jets disposed in a generally triangular arrangement, the three jets of each jet set form therebetween a flow space of generally triangular transverse cross-section, and said vacuum chamber has a side wall which forms additional flow spaces with said outer jets.

11. A fluid jet ejector according to claim 1, wherein:

said nozzle means comprises a plurality of nozzles, respective nozzles being associated with respective jet groups communicating said vacuum chamber to said outlet, and the jets of each jet group are aligned with the associated nozzle to discharge through said vacuum chamber into the associated nozzle a plurality of substantially parallel relatively high velocity jet streams of said primary fluid which entrain secondary fluid entering said chamber through said secondary inlet and carry the entrained secondary fluid from said chamber through the associated nozzle.

12. A fluid jet ejector according to claim 11, wherein:

the jets of each jet group include a plurality of sets of jets each including three jets disposed in a generally triangular arrangement, and the three jets of each jet set form therebetween a flow space of generally triangular transverse cross-section.

13. A fluid jet ejector according to claim 12, wherein:

the number of jets in each jet group is seven.

14. A fluid jet ejector according to claim 1, wherein:

the jets of each jet group have a certain diameter and a generally uniform spacing substantially equal to said diameter between the outer circumferences of adjacent jets.

15. A fluid jet ejector assembly comprising:

a plurality of fluid jet ejectors each comprising a body containing a fluid passage including a primary fluid inlet for receiving a pressurized primary fluid, a fluid outlet, a vacuum chamber between said inlet and outlet, nozzle means communicating said chamber to said outlet, a secondary fluid inlet opening to said chamber for receiving a secondary fluid, and jet means communicating said inlet to said chamber for discharging at least one relatively high velocity jet stream of said primary fluid through said vacuum chamber into said nozzle means in such manner that secondary fluid entering said chamber through said secondary inlet is entrained by said primary fluid and is carried from the chamber with the primary fluid, exhaust tube means spaced from the nozzle means to define a flow space therebetween, means for introducing primary fluid into said flow space, and a secondary fluid inlet line connected to the secondary fluid inlets of the several ejectors for conducting said secondary fluid to the ejectors.

* * * * *